US007808341B2

(12) United States Patent
Aguirre

(10) Patent No.: US 7,808,341 B2
(45) Date of Patent: Oct. 5, 2010

(54) BROADBAND RF CONNECTOR INTERCONNECT FOR MULTILAYER ELECTRONIC PACKAGES

(75) Inventor: Gerardo Aguirre, San Diego, CA (US)

(73) Assignee: Kyocera America, Inc., San Diego, CA (US)

( * ) Notice: Subject to any disclaimer, the term of this patent is extended or adjusted under 35 U.S.C. 154(b) by 123 days.

(21) Appl. No.: 11/709,080

(22) Filed: Feb. 21, 2007

(65) Prior Publication Data

US 2008/0200068 A1 Aug. 21, 2008

(51) Int. Cl.
*H01P 5/02* (2006.01)

(52) U.S. Cl. ..... 333/34; 333/260

(58) Field of Classification Search ..... 333/33, 333/34, 35, 260

See application file for complete search history.

(56) References Cited

U.S. PATENT DOCUMENTS

| | | | | |
|---|---|---|---|---|
| 2,403,252 | A | | 7/1946 | Wheeler |
| 2,455,657 | A | | 12/1948 | Edward |
| 2,492,404 | A | | 12/1949 | Streib |
| 2,508,084 | A | | 5/1950 | Alford |
| 2,517,969 | A | | 8/1950 | Brown |
| 2,611,102 | A | | 9/1952 | Bohlke |
| 2,761,110 | A | | 8/1956 | Edlen |
| 2,810,829 | A | | 10/1957 | Schrock |
| 3,264,584 | A | | 8/1966 | Edwards |
| 3,530,425 | A | | 9/1970 | Vachhani |
| 3,617,953 | A | | 11/1971 | Kingma |
| 3,638,148 | A | | 1/1972 | Hallford |
| 3,745,488 | A | | 7/1973 | Rogers |
| 3,825,864 | A | | 7/1974 | Ramstrom |
| 4,035,054 | A | | 7/1977 | Lattanzi |
| 4,035,748 | A | | 7/1977 | Kusaka et al. |
| 4,365,214 | A | * | 12/1982 | Shillady ..... 333/33 |
| 4,700,159 | A | | 10/1987 | Jones, III |
| 4,821,040 | A | | 4/1989 | Johnson et al. |
| 4,851,859 | A | | 7/1989 | Rappaport |
| 5,019,829 | A | | 5/1991 | Heckman et al. |

(Continued)

FOREIGN PATENT DOCUMENTS

| | | | |
|---|---|---|---|
| GB | 464185 | A | 4/1937 |

(Continued)

OTHER PUBLICATIONS

International Search Report for corresponding PCT application PCT/US08/53880 lists the references above, Jul. 14, 2008.

*Primary Examiner*—Benny Lee
*Assistant Examiner*—Gerald Stevens
(74) *Attorney, Agent, or Firm*—Hogan Lovells US LLP

(57) ABSTRACT

A coaxial transition arrangement including a coaxial connector for connecting a coaxial cable to a multilayer package has an improved coaxial connector for accomplishing impedance matching and providing improved broadband performance. Impedance matching is provided by a metal disk structure comprising a plurality of metal disks mounted on a center conductor pin of the coaxial connector. The disks are mounted in spaced-apart relation on the center conductor pin and have different radiuses which decrease with increasing distance from the base of the center conductor pin. The coaxial connector has a shroud which is configured to accommodate the metal disk structure therein, as does the ring of ground vias forming a part of the multilayer package.

10 Claims, 3 Drawing Sheets

U.S. PATENT DOCUMENTS 5,994,975 A * 11/1999 Allen et al. ..... 333/26
6,028,497 A 2/2000 Allen et al.
6,146,196 A 11/2000 Burger et al.
6,750,657 B2 6/2004 Griessbaum et al.
6,844,803 B2 1/2005 Echols, Jr.
6,992,544 B2 * 1/2006 Barnes et al. ..... 333/33
7,274,271 B2 * 9/2007 Lee ..... 333/33

FOREIGN PATENT DOCUMENTS

GB 849490 9/1960
WO WO 9745899 A1 12/1997

* cited by examiner

BROADBAND RF CONNECTOR INTERCONNECT FOR MULTILAYER ELECTRONIC PACKAGES

BACKGROUND OF THE INVENTION

1. Field of the Invention

The present invention relates to a broadband RF connector interconnect for multilayer electronic packages, and more particularly to impedance matching to provide improved broadband performance in ceramic multilayer packages requiring brazed connectors.

2. History of the Prior Art

It is known in the art to provide a coaxial transition arrangement including a broadband RF connector interconnect for multilayer electronic packages. Such arrangements are commonly used in, for example, radar systems having an electronic package with a transmit/receive module and antenna feed network for the transmitter.

In such arrangements, it is difficult to achieve broadband high frequency RF performance from a coaxial connector transition to a transmission line structure within a multilayer package. It is impossible to compensate the impedance mismatch within the connector by using impedance matching structures inside the package alone. Attempts to compensate connector transition by reducing the braze pad for the pin connection leads to high-risk manufacturing and connector reliability.

Various different arrangements have been tried in an attempt to provide impedance matching and thereby broadband performance in coaxial transition arrangements. Such an arrangement is shown in U.S. Pat. No. 3,745,488 of Rogers. This patent describes a disk 76 and a ring 78 which are moveable within a coaxial structure to achieve impedance matching. However, such structure is relatively complex and not readily adapted to coaxial transition arrangements which couple a coaxial cable to a multilayer package so that impedance matching is achieved with minimum modification. Similar comments apply to U.S. Pat. No. 6,028,497 of Allen in which the impedance of a coaxial transmission line is adjusted by adjusting the width and shape of a pin and the inner diameter of a washer-shaped end of a shroud.

BRIEF DESCRIPTION OF THE INVENTION

The present invention provides impedance matching and improved broadband performance with a broadband RF connector interconnect for multilayer electronic packages in which only relatively minor modification of conventional structures is required. A coaxial transition arrangement comprises a transmission line structure inside a multilayer package, a coaxial cable and a coaxial connector coupling the multilayer package to the coaxial cable. The coaxial conductor includes a center conductor pin having a metal disk structure thereon. The metal disk structure provides impedance matching.

In accordance with the invention, the metal disk structure includes a plurality of metal disks of different size mounted in spaced-apart relation along the center conductor pin. The center conductor pin has a base coupled to the multilayer package, and the plurality of metal disks have decreasing diameters with increasing distance from the multilayer package. The coaxial connector includes a shroud brazed on the multilayer package, surrounding the center conductor pin and the metal disk structure thereon and receiving the coaxial cable therein.

In a preferred arrangement according to the invention, the multilayer package includes a stack of ceramic layers, inside which a coaxial via structure exists. The center conductor pin of the broadband RF connector has a braze pad at a base thereof which is brazed to the stack of the ceramic layers. Within the ceramic layers the center via of the coaxial structure is connected to the braze pad. The multilayer package may include a ring of ground vias for construction of coaxial via structure.

Impedance matching in accordance with the invention is achieved with only relatively minor modification of conventional coaxial structures. More specifically, a plurality of the thin metal disks are mounted on the center conductor pin adjacent the braze pad at the base of the pin. Additionally, the size and shape of a shroud which surrounds the center conductor pin is adjusted so as to accommodate the thin conductive disks.

In a preferred arrangement, three conductive disks are mounted on the center conductor pin in spaced-apart relation adjacent the braze pad of the pin. The diameter of each disk is different from the diameter of the other two disks, and the disks are mounted such that the diameters thereof decrease with increasing distance from the braze pad.

DETAILED DESCRIPTION

Figure 1:
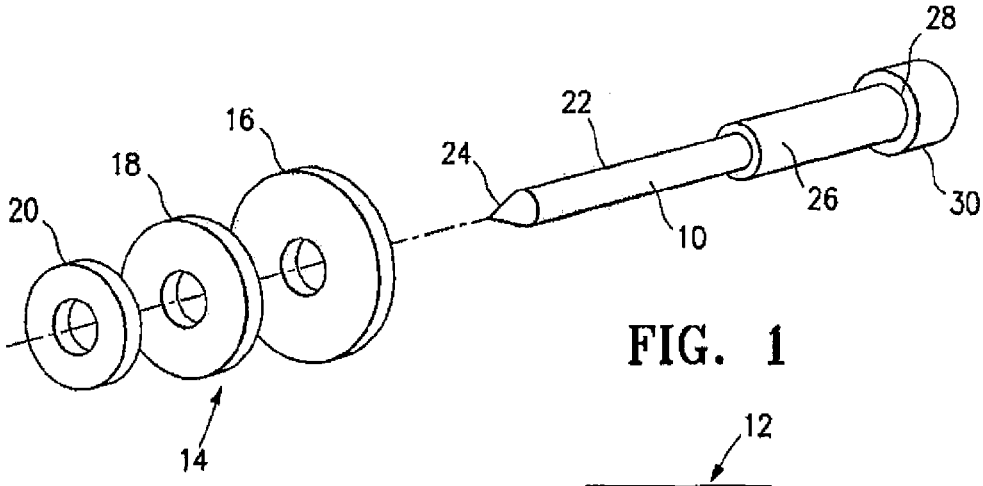
FIG. 1 is a perspective, exploded view of a center conductor pin of a coaxial connector showing the manner in which plural conductive disks are mounted on the center connector pin to achieve impedance matching in accordance with the invention.

FIG. 1 is an exploded perspective view of a center conductor pin 10 of a coaxial connector 12 having a metal disk structure 14 mounted on the pin 10 to provide impedance matching in accordance with the invention. The metal disk structure 14 includes three different disks 16, 18 and 20, each with a radius different than that of the other two disks. The disk 16 has a radius which is larger than the disk 18. The disk 18, in turn, has a radius which is larger than that of the disk 20.

The center conductor pin 10 is of conventional design and has a generally cylindrical portion 22 which terminates in a tip 24. The center conductor pin 10 has a second cylindrical portion 26 of diameter which is larger than the diameter of the cylindrical portion 22. The second cylindrical portion 26 extends between the first cylindrical portion 22 and a base 28 of the center conductor pin on which a braze pad 30 is mounted.

Figure 2:
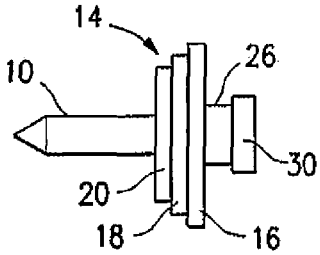
FIG. 2 is a side view of the center conductor pin of FIG. 1 showing the disks mounted thereon in accordance with the invention.

As shown in the side view of FIG. 2, the disks 16, 18 and 20 are mounted in spaced-apart relation along the second cylindrical portion 26 of the center conductor pin 10 adjacent the braze pad 30. The disks 16, 18 and 20 are of varying radii and are located such that the disk 16 is closest to the braze pad 30, the disk 18 of diameter slightly smaller than that of the disk 16 is mounted on the other side of the disk 16 from the braze pad 30, and the disk 20 of diameter slightly smaller than that of the disk 18 is mounted on the other side of the disk 18 from the disk 16.

Figure 3:
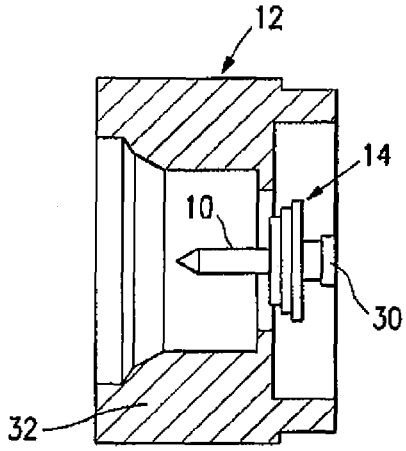
FIG. 3 is a side sectional view of a coaxial connector in which the center conductor pin of FIGS. 1 and 2 is mounted within a surrounding shroud.

The center conductor pin 10 with the metal disk structure 14 thereon form a part of the coaxial connector 12 which is shown in FIG. 3. The center conductor pin 10 is concentrically disposed within and is surrounded by a shroud 32. The shroud 32 is of conventional design except that it is enlarged as necessary to accommodate the metal disk structure 14 on the center conductor pin 10.

Figure 4:
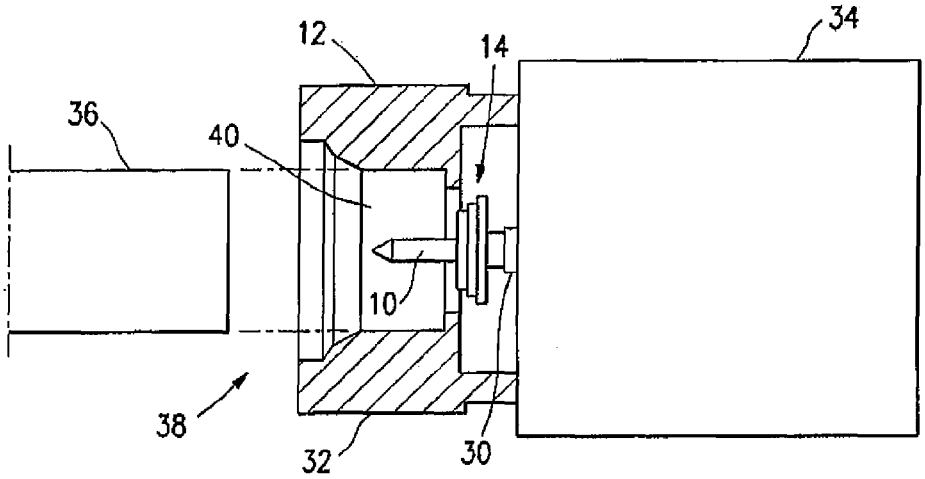
FIG. 4 is a side sectional view of the coaxial connector of FIG. 3 showing the manner in which it is coupled to a multilayer package and the manner in which it receives a coaxial cable, to provide a coaxial transition arrangement.

FIG. 4 shows the coaxial connector 12 of FIG. 3 mounted on a multilayer package 34 and receiving a coaxial cable 36 so as to provide a coaxial transition arrangement 38 between the multilayer package 34 and the coaxial cable 36. The center conductor pin 10 of the coaxial connector 12 is coupled to the multilayer package by way of the braze pad 30 at the base thereof. The braze pad 30 is brazed to the multilayer package 34. The shroud 32 is also coupled to the multilayer package 34, as shown in FIG. 4. The multilayer package 34 may comprise a stack of ceramic layers.

The shroud 32 has an opening 40 therein for receiving the coaxial cable 36 to couple the coaxial cable 36 to the multilayer package 34 by way of the coaxial connector 12.

Figure 5:
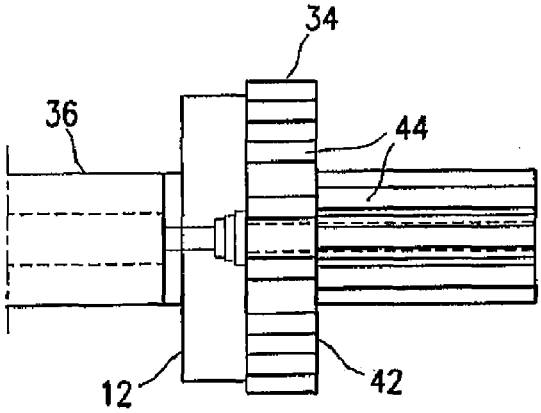
FIG. 5 is a side view of a coaxial transition arrangement similar to that shown in FIG. 4, in which the coaxial structure within the multilayer package includes and iris and a ring of grounded vias.
Figure 6:
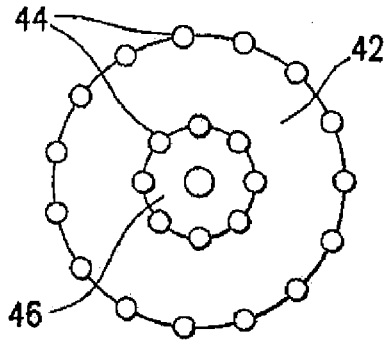
FIG. 6 is a plan view of the ground ring and iris of FIG. 5.
Figure 7:
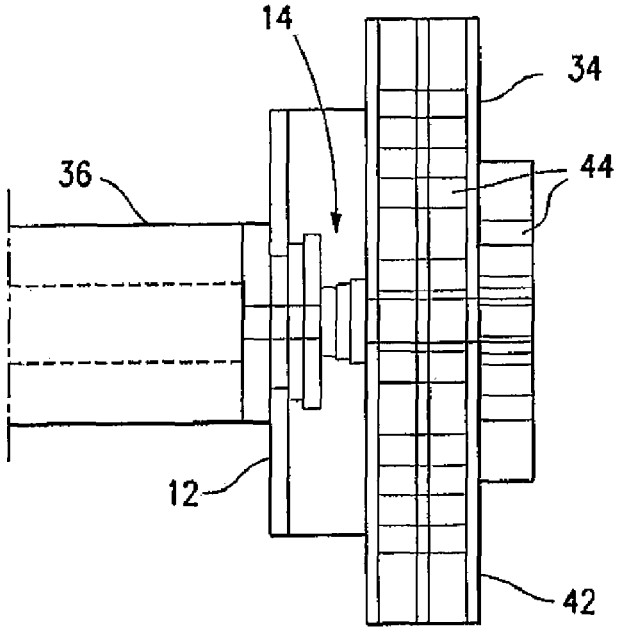
FIG. 7 is a side view similar to that of FIG. 5 and showing the manner in which the ground ring has the coaxial connector coupled thereto.

The transmission line structure within the multilayer package 34 may comprise a coaxial via structure, as in the case of the present example, or it may comprise a slabline structure or a stripline structure. FIG. 5 shows the coaxial cable 36 coupled to the coaxial connector 12 which is mounted on the multilayer package 34 including a ground ring 42 which is connected to a circular arrangement of grounded vias 44. The ground ring 42, which is shown in FIG. 6 as well as FIGS. 5 and 7, has an iris opening 46 therein for accommodating the center conductor via of the coaxial structure within the multilayer package.

Figure 8:
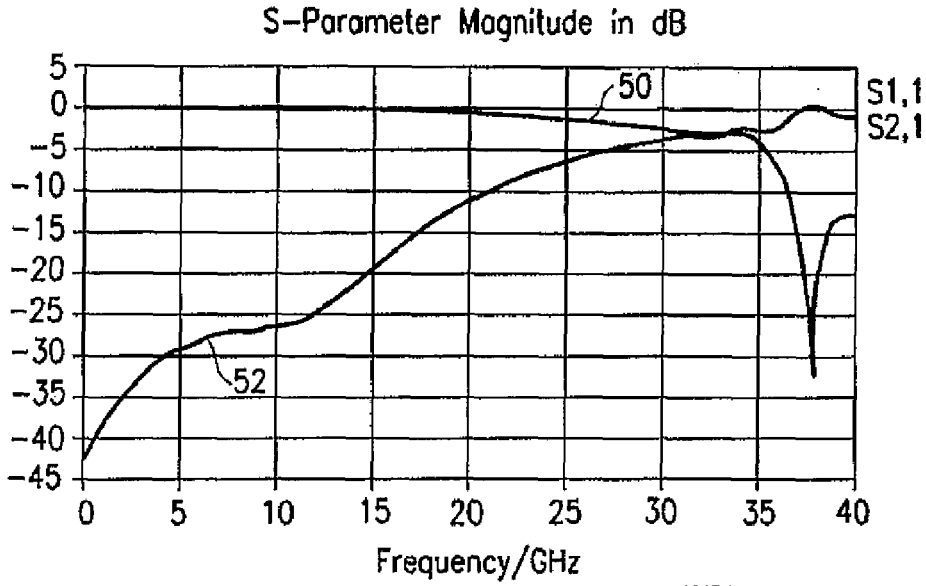
PRIOR ART FIG. 8
FIG. 8 is a diagrammatic plot of S-parameter magnitude in dB as a function of frequency in GHz for a conventional coaxial transition arrangement, without the impedance matching conductive disks, and showing reflection loss or return loss, and also insertion loss.

As previously noted, the metal disk structure 14 consisting of the disks 16, 18 and 20 on the center conductor pin 10 provides impedance matching with the result that improved broadband performance is achieved. This is illustrated by the diagrammatic plots in FIGS. 8 and 9. FIG. 8 is a plot of S-parameter magnitude in dB as a function of frequency/GHz for a conventional coaxial connector. An upper curve 50 is insertion loss, and a lower curve 52 is reflected loss or return loss. As shown in FIG. 8, the upper curve 50 representing insertion loss deviates from the zero axis at a frequency of approximately 20 GHz indicating that the performance of the conventional coaxial connector is considerably less than ideal.

Figure 9:
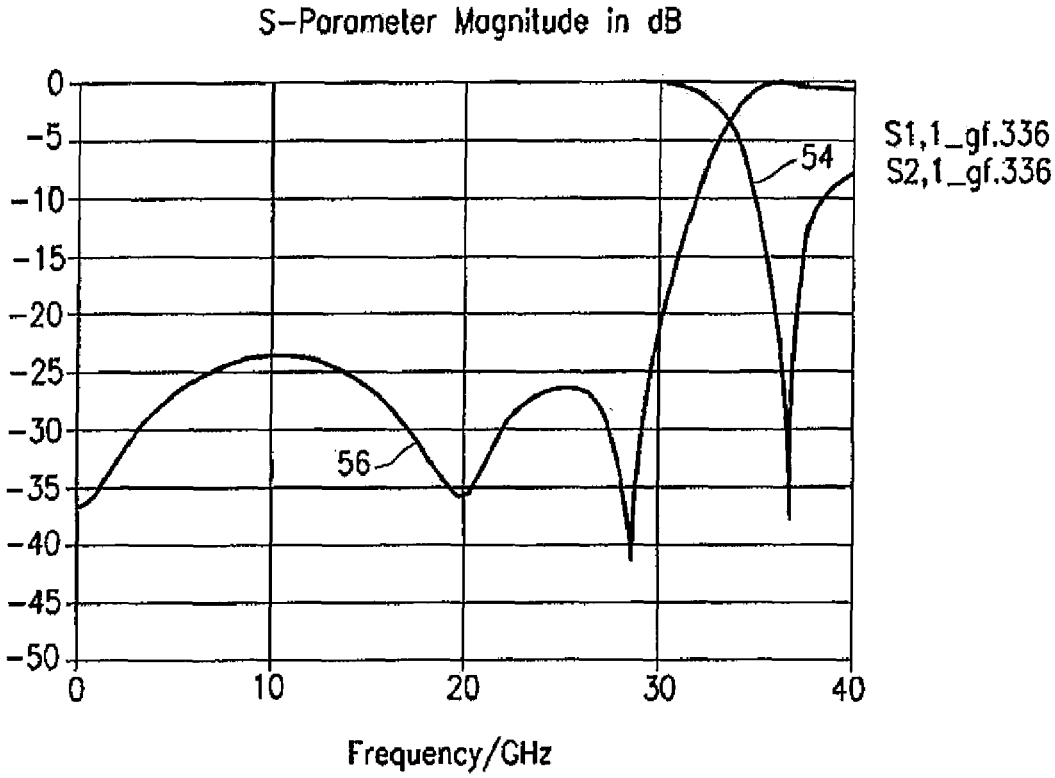
FIG. 9 is a diagrammatic plot similar to that of FIG. 8 but with the conductive disks mounted on the center conductor pin to provide impedance matching in accordance with the invention.

FIG. 9 is a diagrammatic plot similar to that of FIG. 8 but representing the performance provided by the coaxial connector 12 with the metal disk structure 14 according to the present invention. An upper curve 54 represents insertion loss, and a lower curve 56 represents reflected loss or return loss. As will be seen from FIG. 9, in the case of the coaxial connector 12 according to the invention, the insertion loss represented by the curve 54 remains at zero up to a frequency of approximately 32 GHz, representing far better performance than in the case of the conventional coaxial connector illustrated by the plot of FIG. 8. The improved performance is due to the impedance matching provided by the metal disk structure 14.

I claim:

1. A coaxial transition arrangement comprising the combination of:

a multilayer package;

a coaxial cable; and a coaxial connector coupling the multilayer package to the coaxial cable, the coaxial connector including a center conductor pin having a metal disk structure thereon, the metal disk structure comprising at least three metal disks mounted contiguously in actual contact with each other along the conductor pin and providing impedance matching.

2. The invention set forth in claim 1, wherein the center conductor pin has a base coupled to the multilayer package and the at least three metal disks have decreasing diameters with increasing distance from the multilayer package.

3. The invention set forth in claim 1, wherein the coaxial connector includes a shroud mounted on the multilayer package, surrounding the center conductor pin and the metal disk structure thereon and receiving the coaxial cable therein.

4. A coaxial connector having a center conductor pin surrounded by a shroud, the connector having a plurality of conductive disks of different size mounted contiguously in actual contact with each other on the center conductor pin to provide impedance matching, the plurality of conductive disks comprising at least three conductive disks.

5. The invention set forth in claim 4, wherein the plurality of conductive disks are comprised of relatively thin metal disks of different radii.

6. The invention set forth in claim 4, further including a multilayer package having the coaxial connector mounted thereon.

7. The invention set forth in claim 6, wherein the multilayer package includes a stack of ceramic layers and the center conductor pin has a braze pad at a base thereof brazed to the stack of ceramic layers.

8. The invention set forth in claim 6, wherein the center conductor pin has a base thereof mounted on the multilayer package and the at least three conductive disks comprise three metal disks which have decreasing diameters with increasing distance from the multilayer package.

9. The invention set forth in claim 6, wherein the multilayer package includes a ring of ground vias having an aperture therein for receiving the center conductor pin therein.

10. The invention set forth in claim 6, further including a coaxial cable connected to the coaxial connector.

* * * * *